US007791442B2

(12) United States Patent
Zou

(10) Patent No.: US 7,791,442 B2
(45) Date of Patent: Sep. 7, 2010

(54) ELECTRONIC TRANSFORMER USED IN LOW-VOLTAGE LAMPS

(75) Inventor: Gaodi Zou, Foshan (CN)

(73) Assignee: Eaglerise Electric & Electronic (Foshan) Co., Ltd., Foshan (CN)

( * ) Notice: Subject to any disclaimer, the term of this patent is extended or adjusted under 35 U.S.C. 154(b) by 279 days.

(21) Appl. No.: 11/943,598

(22) Filed: Nov. 21, 2007

(65) Prior Publication Data

US 2008/0186119 A1 Aug. 7, 2008

Related U.S. Application Data

(63) Continuation of application No. PCT/CN2005/002330, filed on Dec. 28, 2005.

(30) Foreign Application Priority Data

May 30, 2005 (CN) ..... 2005 1 0034822
Dec. 28, 2005 (WO) ..... PCT/CN2005/002330

(51) Int. Cl.
*H01F 27/02* (2006.01)

(52) U.S. Cl. ..... 336/90

(58) Field of Classification Search ..... 336/65, 336/90–96, 200, 220–222, 225, 229
See application file for complete search history.

(56) References Cited

U.S. PATENT DOCUMENTS 7,342,476 B2 * 3/2008 Fushimi ..... 336/200
7,585,177 B2 * 9/2009 Yashiki et al. ..... 439/226
2008/0157696 A1 * 7/2008 Pokharna et al. ..... 315/276

FOREIGN PATENT DOCUMENTS

CN 2655401 Y 11/2004
JP H11-008145 A 1/1999

* cited by examiner

*Primary Examiner*—Tuyen T. Nguyen
(74) *Attorney, Agent, or Firm*—Hiroe & Associates; Taras P. Bemko

(57) ABSTRACT

An electronic transformer used in low voltage lamps mainly includes an outer case, an electronic controlling circuit and a voltage switch isolating transformer. Therein, the outer case consists of an upper cover plate (1) and a lower cover plate (2); the electronic controlling circuit and the magnetic core coil (6) of the voltage switch isolating transformer are put between the upper cover plate (1) and the lower cover plate (2); characterized in that the outside of the lower cover plate (2) provides concaving grooves (9) adapting to coil winding, the corresponding line passage holes (10) and a center hole (12) of the lower cover plate; the windings of the voltage switch isolating transformer are embedded in the grooves (9) through the center hole (12) of the lower cover plate, the line passage holes (10) and the center hole of the magnetic core coil (6), the upper cover (1) plate and the lower cover plate (2) are embedded with each other. The electronic transformer in accordance with the invention is portable, thin, beautiful, convenient, with better heat dispersion, and up to the correlative international safety standard.

11 Claims, 5 Drawing Sheets

ELECTRONIC TRANSFORMER USED IN LOW-VOLTAGE LAMPS

RELATED APPLICATIONS

This application is a continuation of International Application PCT/CN2005/002330, with an international filing date of Dec. 28, 2005, now abandoned, which claims priority to Chinese Application 200510034822.2, having a filing date of May 30, 2005, now pending, all of which are hereby incorporated herein by reference.

FIELD OF THE INVENTION

The invention relates to an electronic transformer, in particular an electronic transformer used in low-voltage lamps.

BACKGROUND OF THE INVENTION

Low-voltage lamps distributed in the market presently, such as quartz halogen-tungsten lamps, have the properties of projecting in close quarters and being used safely etc., for theirs high color rendering index, they have been used extensively in commerce and domesticity. But it's necessary to use a voltage reducing transformer to supply power for the normal operation of the lamps, and to switch town electricity into an isolated and safe low voltage electricity. At present, for the voltage switch isolating transformer in this kind of electronic transformers, primary and secondary windings are normally winded on a magnetic core, and after insulation they are installed in the outer case of the electronic transformers. The outer case will isolate the voltage switch isolating transformer from environment completely. If it is desired to reduce furthermore the thickness of the electronic transformer with such a structure, the key problem is to reduce the height of the voltage switch isolating transformer. It is also a problem hardly to be broken through. For it is a magnetoelectricity apparatus of power, only reduces the thickness of materials, the safety and the reliability of the apparatus will not meet the requirement, and only reduces the thickness of the magnetic core, the magnetic property and the mechanical intensity of the magnetic core will deteriorate quickly, even to the extent that the apparatus can not be operated normally. At the present market, when the low voltage quartz halogen-tungsten lamp is used in the furniture such as cupboard, it is desirable that the electronic transformer installed coordinately can be a superthin one. The space occupied by the transformer can not be too large and too high and the heat dispersion should be good enough so as to it can be used conveniently. Furthermore, to meet the particular requirements of the different installation space and structure, it is desired to be a lighter, thinner and more beautiful one.

CONTENT OF THE INVENTION

The object of the invention is to provide a lighter, thinner and more beautiful electronic transformer which is easy to be operated and has a good heat dispersion property and up to the correlative international safety standard so as to solve the technical problems of the electronic transformer mentioned above.

The object of the invention is carried out by the following embodiments:

An electronic transformer used in low-voltage lamps mainly includes an outer case, an electronic controlling circuit and a voltage switch isolating transformer, in which the outer case consists of an upper cover plate 1 and a lower cover plate 2; the electronic controlling circuit and the magnetic core coil 6 of the voltage switch isolating transformer are put between the upper cover plate 1 and the lower cover plate 2; the outside of the lower cover plate 2 provides concaving grooves 9 adapting to coil winding, the corresponding line passage holes 10 and a center hole 12 of the cover plate; the windings of the voltage switch isolating transformer are embedded in the grooves 9 through the center hole 12 of the cover plate, the line passage holes 10 and the center hole of the magnetic core coil 6; the upper cover 1 plate and the lower cover plate 2 are embedded with each other.

The outside of the upper cover plate 1 provides concaving grooves 15 adapting to coil winding, the corresponding line passage holes 16 and a center hole 17 of the cover plate; the upper cover plate 1 and the lower cover plate 2 are embedded with each other; the windings of the voltage switch isolating transformer are embedded in the grooves 9 and the grooves 15 through the center hole 12 of the lower cover plate 2, the line passage holes 10, the center hole 17 of the upper cover plate 1, the line passage holes 16 of the upper cover plate and the center hole of the magnetic core coil 6.

The inside of the upper cover plate 1 or of the lower cover plate 2 provides a cavity 4 and a flange 5, and the magnetic core coil 6 is put between the cavity 4 and the flange 5.

In accordance with the basic structure mentioned above, a plastic insulating jacket 3 for the magnetic core coil 6 may also be put between the upper cover plate 1 and the lower cover plate 2; the plastic insulating jacket 3 provides a center hole 13, and the grooves 7 adapting to coil winding are put on the top of the jacket; the magnetic core coil 6 is put between the plastic insulating jacket 3 and lower cover plate 2; the windings of the voltage switch isolating transformer are embedded in the grooves 7 and the grooves 9 through the center hole 13 of the plastic insulating jacket 3, the center hole of the magnetic coil 6, the center hole 12 of the lower cover plate and the line passage holes 10.

The grooves 7 put on the top of the plastic insulating jacket 3 form protruding grooves in shape of a rabbet, the height of which is higher than the top plane 11 of the jacket 3, and the height of whose protruding part equals to the thickness of the upper cover plate's wall; the upper cover plate 1 has a hole 8 on it, and the grooves 7 are embedded properly in the hole 8.

The plastic insulating jacket 3 has a shape of an inverse flat pan, and the magnetic core coil 6 is put in the plastic insulating jacket 3.

Line passage holes 14 are put in the grooves 7, and near to the outer end of the plastic insulating jacket's top. The windings can go into the line passage holes 10 of the lower cover plate through the grooves 7 and the line passage holes 14.

The inside of the lower cover plate 2 provides the cavity 4 and the flange 5, and the magnetic core coil 6 is put in the space formed between the plastic insulating jacket 3, the cavity 4 and the flange 5.

For the windings of the fixed electronic transformer are protruded from the upper cover plate or the lower cover plate, the surface of the windings can be disposed with a high strength insulating material to assure the safety of the windings and the entire transformer.

To prevent damages of the insulating layer of the exposed secondary windings under an extreme situation, a protecting film can be adhered additionally to the windings on the outside of the cover plate.

Comparing with the prior art, the upper cover plate or the lower cover plate of the invention has suitable grooves adapting to the windings, and the cover plates themselves can be used as a framework for the windings, that is the windings of the transformer can be winded directly on the cover plates of the outer case, so it is not necessary to apply an additional protecting packing case on the outside of the windings of the transformer. Therefore, if suitable windings are set on the upper cover plate or the lower cover, the thickness of the electronic transformer can be reduced by at least the thickness of one cover plate's wall which is about 2 mm; if suitable windings are set on the upper cover plate and the lower cover plate at the same time, the thickness of the electronic transformer can be reduced by at least the thickness of two cover plate's walls which is about 4~5 mm.

With reference to the invention, if a hole is bored on the upper cover plate, the coil winded on the plastic insulating jacket can be embedded properly into the hole so that the upper cover plate can be retracted in the direction of the lower cover plate by at least the thickness of one cover plate's wall which is about 2 mm. Furthermore due to the lower cover plate has also grooves adapting to the windings, the electric windings can be winded in the grooves properly, that is, the wall of the lower cover plate can be used directly as the framework for the windings, so that the thickness of the transformer can be reduced by at least the thickness of one cover plate's wall which is about 2 mm. When the structure is applied, the thickness of the electronic transformer can be reduced totally by 4~5 mm.

For the high voltage windings and the low voltage windings are isolated by the plastic insulating jacket, the cavity and the flange, the creepage distance between the high voltage windings and the low voltage windings can be increased, and the electricity isolation between the two windings become safer.

For the windings are protruded directly from the upper cover plate or the lower cover plate, and they are arranged regularly, the appearance of the electronic transformer becomes more beautiful and the heat of the transformer is easier to be dispersed. In practical applications, the transformer is portable, beautiful and the space occupied is smaller, and it is more convenient to be installed with other decorating structures.

The technique in accordance with the invention is suitable for not only the electronic transformers for the low-voltage lamps, but also for various power supplying adapters, the converters and the transformers which have safe low voltage outputs and need to be thin.

BRIEF DESCRIPTION OF THE DRAWING

Description of drawings is as followings:

The drawing 1 is a perspective view of the embodiment 1 in accordance with the invention.

Figure 1:
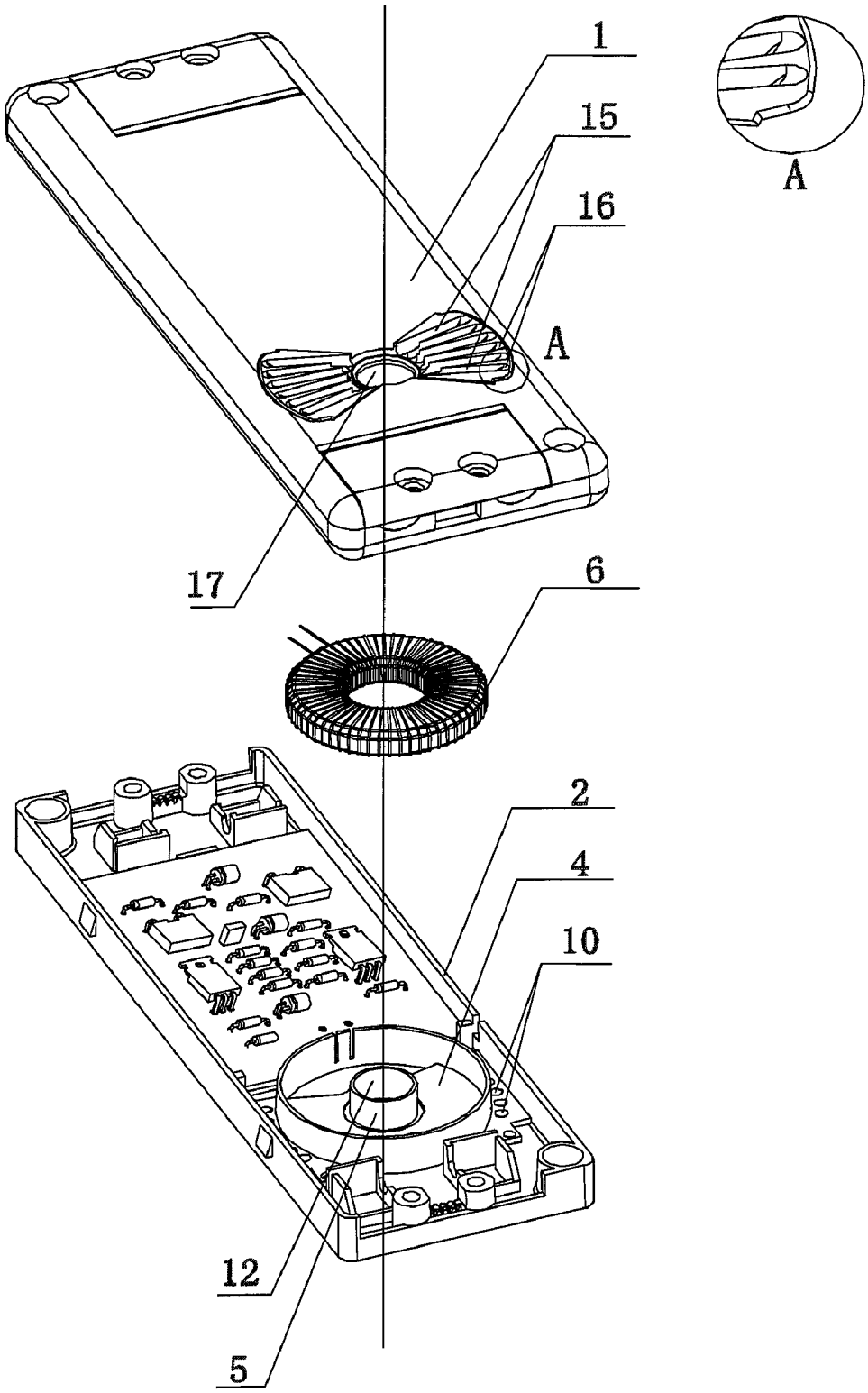
Figure 2:
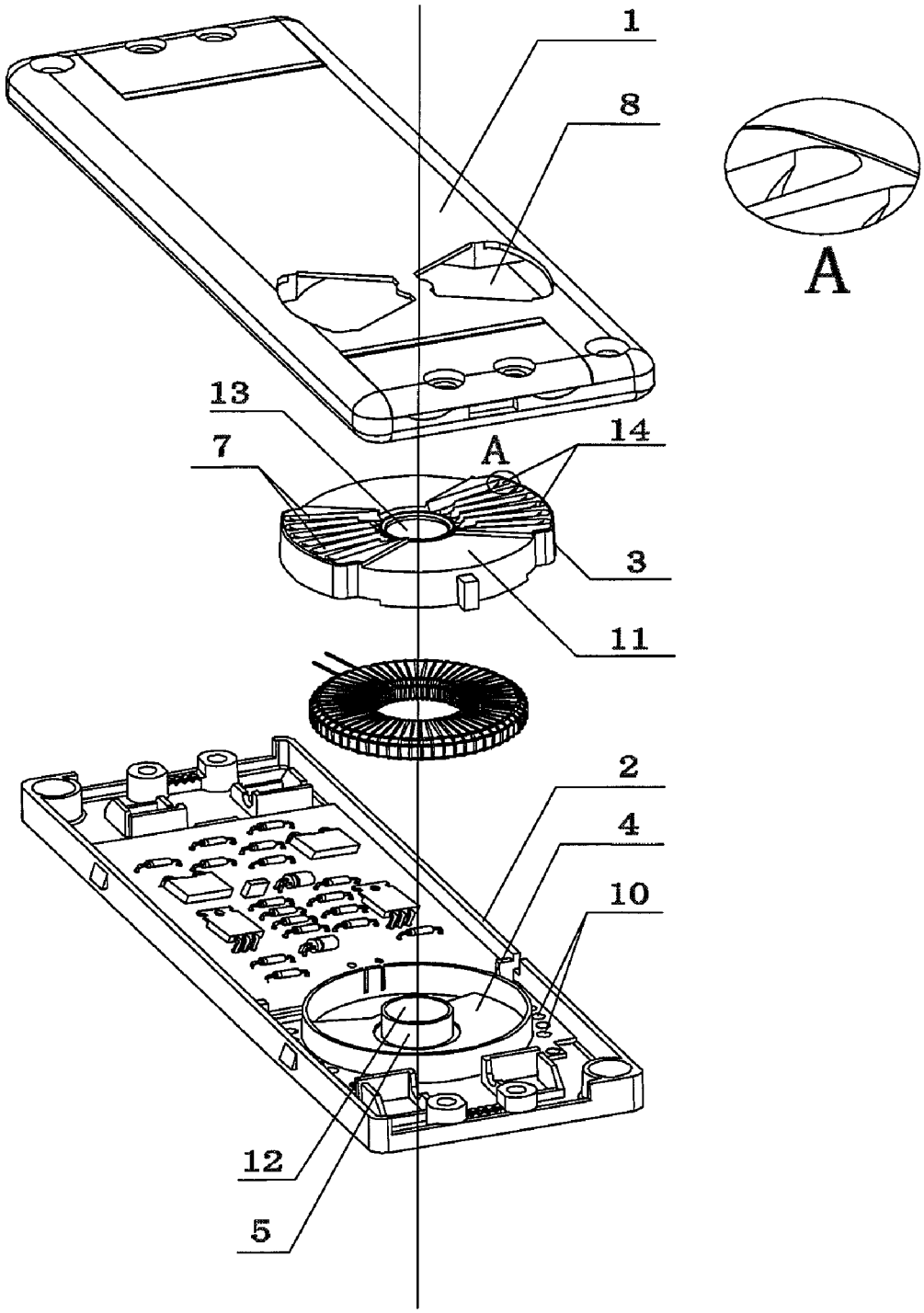
Figure 3:
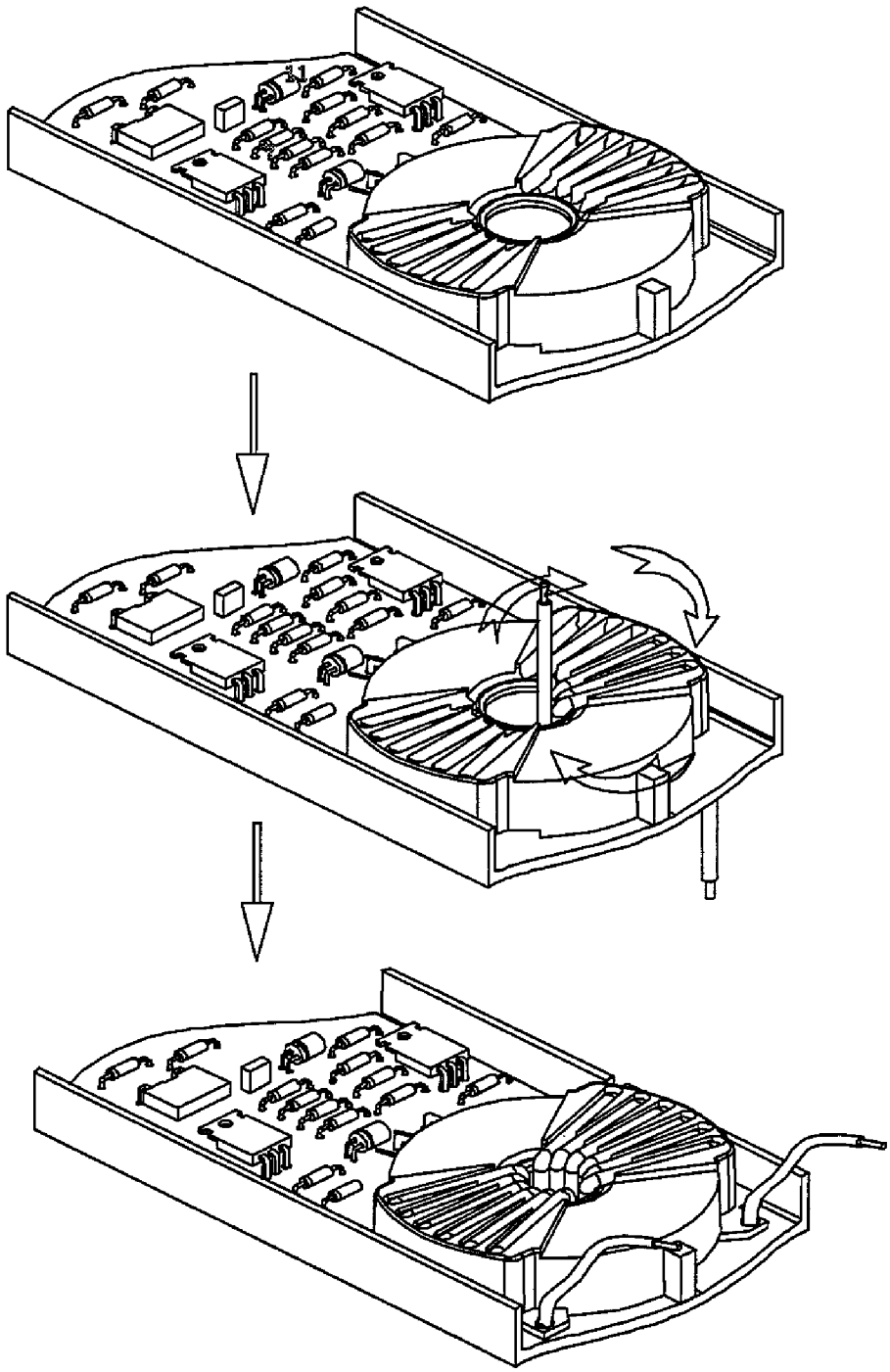
Figure 4:
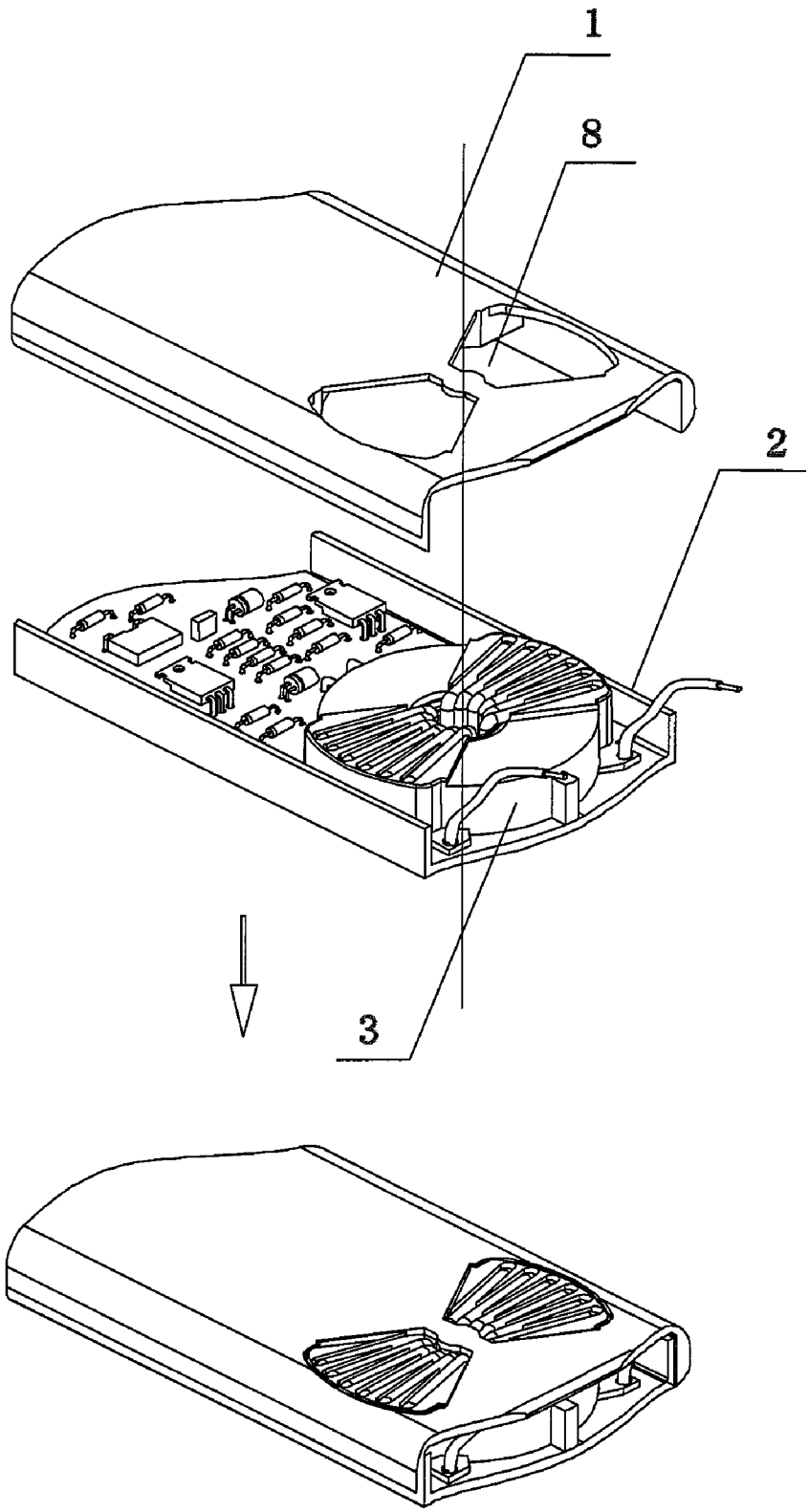
Figure 5:
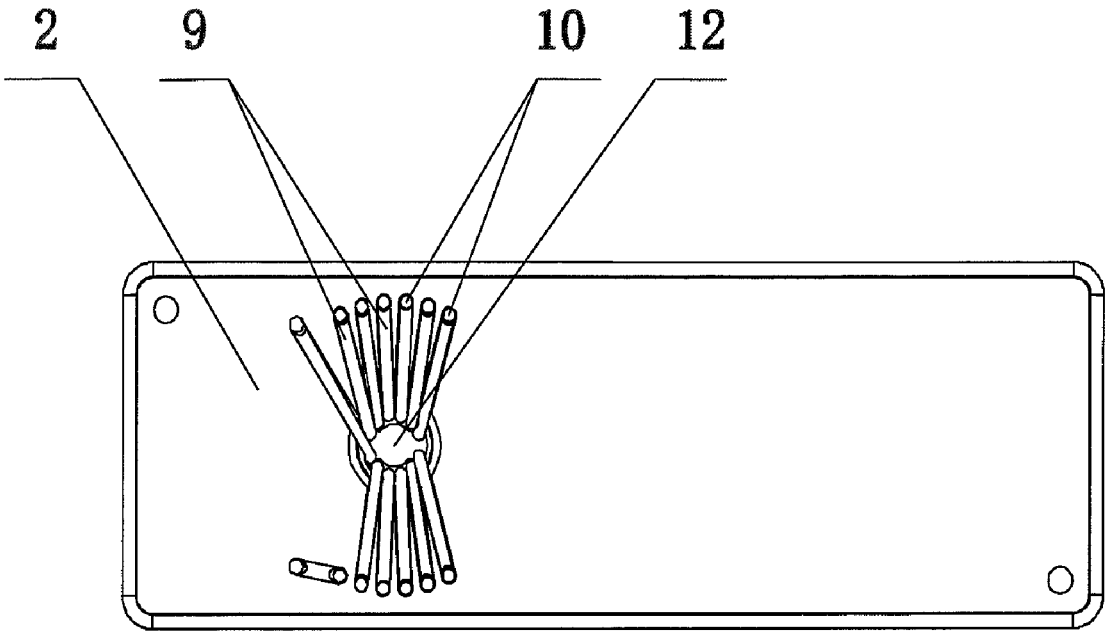
Figure 6:
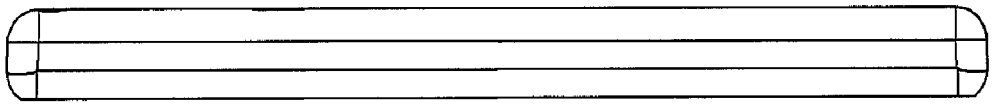

The drawing 2 is a perspective view of the embodiment 2 in accordance with the invention.

The drawing 3 is a picture for the assembling procedure of the secondary windings of the embodiment 2 in accordance with the invention.

The drawing 4 is a picture for the assembling procedure of the upper cover plate and the lower cover plate of the embodiment 2 in accordance with the invention.

The drawing 5 is a front view for the product in accordance with the invention.

The drawing 6 is a top view for the product in accordance with the invention.

In the drawings, there are upper cover plate 1, lower cover plate 2, plastic insulating jacket 3, cavity 4, flange 5 in the cavity, magnetic core coil 6, grooves 7, hole 8 of the upper cover plate, concaving grooves 9 of the lower cover plate, line passage holes 10, top plane 11 of the plastic insulating jacket, center hole 12 of the lower cover, center hole 13 of the plastic insulating jacket, line passage holes 14 of the plastic insulating jacket, concaving grooves 15 of the upper cover plate, line passage holes 16 of the upper cover plate, center hole 17 of the upper cover plate.

DETAILED DESCRIPTION OF EMBODIMENTS

The invention will be illustrated furthermore by the following embodiments combined with the drawings.

The Embodiment 1

As shown in the drawing 1, the present invention is composed mainly of the outer case, the electronic controlling circuit and voltage switch isolating transformer, in which the outer case consists of the upper cover plate and the lower cover plate. The primary windings are winded firstly on the magnetic core, and form the magnetic core coil 6 of the voltage switch isolating transformer after insulation. The magnetic core coil 6 is put between the upper cover plate and the lower cover plate; the magnetic core coil 6 is a circle, of course it can also be a ellipse, a square or other geometrical shapes. When the magnetic core coil 6 is a circle, ellipse, square or other various geometrical shape, the shape of the cavity 4 and of the flange 5 in the cavity will be changed correspondingly.

As shown in the drawing 1 and the drawing 5, the outside of the lower cover plate 2 provides the concave grooves 9 adapting to the windings, the corresponding line passage holes 10 and a center hole 12 of the cover plate.

As shown in the drawing 1, the outside of the upper cover plate 1 provides the concave grooves 15 adapting to the windings, the corresponding line passage holes 16 and the center hole 17 of the cover plate; the upper cover plate 1 and the lower cover plate are embedded with each other; the secondary windings of the voltage switch isolating transformer are embedded in the grooves 9 and the grooves 15 through the center hole 12 of the lower cover plate 2, the line passage holes 10, the center hole of the magnetic core coil 6, the center hole 17 of the upper cover plate and the line passage holes 16. Thus the upper and lower cover plates themselves can be used as the framework for the windings, that is the windings of the transformer are winded directly on the cover plates of the outer case. In practical applications, the windings of the voltage switch isolating transformer can merely be put on one of the upper and lower cover plates, for example, on the lower cover plate 2, the reduction of the thickness of the electronic transformer is reduced by about 2 mm, but it is convenient to repair.

As shown in the drawing 1, the inside of the upper cover plate 1 or the lower cover plate 2 links fixedly the circle cavity 4 and the flange 5 which can be installed correspondingly with the internal hole of the magnetic core coil 6; the center of the flange 5 is the center hole 12 of the lower cover plate. The magnetic core coil 6 is put between the cavity 4 and the flange 5. In practical applications, the cavity 4 and the flange 5 may be omitted. Alternatively the cavity 4 and the flange 5 may be set on the inside of both cover plates or of any one of the cover plate; and the cavity 4 and the flange 5 may be connected integratedly with the cover plate or the cover plate, or connected with them or it separately. Additionally the cavity 4 and the flange 5 may be used selectively, that is they are not to be needed at the same time; but it is preferable that the cavity 4 and the flange 5 are connected integratedly with the cover plates, and the cavity 4 and the flange 5 are set on the upper cover plate and the lower cover plate at the same time. It is preferable that the inside and the outside of the upper and the lower cavities, and the upper and the lower flanges can be embedded with each other suitably, so as to increase the creepage distance between the high and low voltage windings of the transformer to increase the safety.

The Embodiment 2

As shown in the drawing 2, the drawing 3 and the drawing 4, it is another structure to carry out the present invention; the upper cover plate 1 has a fan-shaped hole 8, a plastic insulating jacket 3 for protecting the magnetic core coil is set between the upper cover plate and the lower cover plate. A structure of setting secondary windings on the plastic insulating jacket 3 replaces the structure of directly setting secondary windings on the upper cover.

As shown in the drawing 2, that the circle cavity 4 and the flange 5 are connected fixedly on the inside of the lower cover plate 2, the center of the flange 5 is the center hole 12 of the lower cover. In practical applications, the cavity 4 and the flange 5 may be omitted.

As shown in the drawing 2, the plastic insulating jacket 3 has a shape of an inverse flat pan, there is a center hole 13 on it's center area, and the jacket 3 and the cavity 4 are embedded with each other. The magnetic core coil 6 is put in the space formed between the plastic insulating jacket 3, the cavity 4 and flange 5 of the lower cover plate 2. The plastic insulating jacket 3 provides the grooves 7 adapting to the windings and the line passage holes 14. In practical applications, the plastic insulating jacket 3 may be also a plane in shape. In addition, if there is not any cavity 4 and flange 5, the plastic insulating jacket 3 can be used alone without a structure of the cavity 4 to be embedded with. All these are equivalent structures in applications.

As shown in the drawing 2, the grooves 7 put on the top of the plastic insulating jacket 3 form protruding grooves in shape of a rabbet, the height of which is higher than the top plane 11 of the jacket 3, and the height of whose protruding part equals to the thickness of the upper cover plate's wall. As shown in the drawing 4, the upper cover plate 1 has a hole 8 on it, so that the grooves 7 are embedded properly in the hole 8 to assure that the peak of the grooves 7 is placed on the same level as the outside of the upper cover plate 1. Of course, in practical applications, the grooves 7 may also be concaving grooves that is on the same level as the top plane 11. Thus the size and the form of the hole 8 must match the form of the top of the plastic insulating jacket 3 so that the top of the plastic insulating jacket 3 can be embedded entirely into the hole 8. Thus the top of the plastic insulating jacket 3 can be embedded suitably into the upper cover plate and be used directly as a part of the covering surface of the upper cover plate, that is the upper cover plate is retracted by the thickness of one cover plate's wall on the direction of lower cover plate.

In practical applications, the cavity 4 and the flange 5 may be connected fixedly or separately with the lower cover plate 2, all these are equivalent structures in applications. But it is preferable that they are connected fixedly, and the cavity 4 and the plastic insulating jacket 3 are embedded with each other. Therefore the creepage distance between high and low voltage windings of the transformer can be increased, and the safety and the reliability are increased.

As shown in the drawing 2 and the drawing 5, the position on the outside of the lower cover plate which is opposite to the cavity 4 provides suitable concaving grooves 9 for the windings, corresponding line passage holes 10 and the center hole 12 of the lower cover plate.

As shown in the drawing 3, the secondary windings of the voltage switch isolating transformer are embedded into the grooves 7 and the grooves 9 through the center hole 13 of plastic insulating jacket 3, the center hole of the magnetic core coil 6, the center hole 12 of the lower cover plate, the line passage holes 10 and the line passage holes 14. The lower cover plate 2 and plastic insulating jacket 3 may be used as the framework for the secondary windings, and the primary and secondary windings may be isolated by it also.

As shown in the drawing 2, the line passage holes 14 are put in the grooves 7, and near to the outer end of the plastic insulating jacket's top. The windings can go into the line passage holes 10 of the lower cover plate through the grooves 7 and the line passage holes 14. In practical applications, the line passage holes 14 may be omitted. When the secondary windings are winded, they may go into the line passage holes 10 of the lower cover plate 2 around the outer wall of the plastic insulating jacket 3. All these are equivalent structures in applications.

As shown in the drawing 5 and the drawing 6, the grooves 9 set on the lower cover plate 2 are concaving ones, the peak of the which is placed on the same level as the outside of the lower cover plate 2.

The inner depth of the grooves 7 and the grooves 9 should insure that the secondary windings will not higher than the peak of the grooves after winding. One circle or more circles of the secondary windings are placed in each groove of the grooves 7 and the grooves 9. The number arranged for the grooves 7 and the grooves 9 can be figured out beforehand depending on the real needs, and the number may be selected correspondingly In according to the electronic transformer installed based on the two projects said above, the low voltage secondary windings are put in the grooves, and the peak of the grooves is placed on the same level as the surface of the upper and lower cover plates. But due to the windings of the installed electronic transformer are exposed on the upper and lower cover plates, the surface of the windings can be disposed with a high strength insulating material to assure the safety of the low voltage windings and the entire transformer. The protruded part of the secondary windings from the upper and lower cover plates forms regular lines which looks very good and has an effective heat dispersion.

To prevent the insulating layer of the exposed low voltage secondary windings from damage under an extreme situation, a protecting film may be adhered to the windings on the outside of the cover plate. The protecting film may also be a label.

If the technique of the present invention is used to produce various thin power supplying adapters, converters and transformers which have safe low voltage outputs, the electronic controlling circuit may not be the necessary components.

The invention claimed is:

1. An electronic transformer used in low-voltage lamps mainly includes an outer case, an electronic controlling circuit and a voltage switch isolating transformer, in which the outer case consists of an upper cover plate (1) and a lower cover plate (2), the electronic controlling circuit and a magnetic core coil (6) of the voltage switch isolating transformer are put between the upper cover plate (1) and the lower cover plate (2), characterized in that:

an outside surface of the lower cover plate (2) provides concaving grooves (9) adapting to coil winding, corresponding line passage holes (10) and a center hole (12) of the lower cover plate;

windings of the voltage switch isolating transformer are embedded in the grooves (9) through the center hole (12) of the lower cover plate, the line passage holes (10) and a center hole of the magnetic core coil (6); and the upper cover (1) plate and the lower cover plate (2) are embedded with each other.

2. The electronic transformer for low-voltage lamps according to claim 1, characterized in that:

a plastic insulating jacket (3) for the magnetic core coil (6) is put between the upper cover plate (1) and the lower cover plate (2);

the plastic insulating jacket (3) provides a center hole (13), and grooves (7) adapting to coil winding are put on a top surface of the jacket;

the magnetic core coil (6) is put between the plastic insulating jacket (3) and the lower cover plate (2); and the windings of the voltage switch isolating transformer are embedded in the grooves (7) and the grooves (9) through the center hole (13) of the plastic insulating jacket (3), the center hole of the magnetic coil (6), the center hole (12) of the lower cover plate and the line passage holes (10).

3. The electronic transformer for low-voltage lamps according to claim 2, characterized in that:

the grooves (7) put on the top surface of the plastic insulating jacket (3) form protruding grooves in a shape of a rabbet, a height of which is higher than a top plane (11) of the plastic insulating jacket (3), and a height of whose protruding part equals to a thickness of an upper cover plate (1) wall; and the upper cover plate (1) has a hole (8) on it, and the grooves (7) are embedded properly in the hole (8).

4. The electronic transformer for low-voltage lamps according to claim 2, characterized in that:

the plastic insulating jacket (3) has a shape of an inverse flat pan; and the magnetic core coil (6) is put in the plastic insulating jacket (3).

5. The electronic transformer for low-voltage lamps according to claim 4, characterized in that line passage holes (15) are put in the grooves (7), and near to an outer end of the top surface of the plastic insulating jacket (3); and the windings go into the line passage holes (10) of the lower cover plate through the grooves (7) and line passage holes (14).

6. The electronic transformer for low-voltage lamps according to claim 1, characterized in that:

an inside of the upper cover plate (1) or of the lower cover plate (2) provides a cavity (4) and a flange (5); and the magnetic core coil 6 is put between the cavity (4) and the flange (5).

7. The electronic transformer for low-voltage lamps according to claim 2, characterized in that:

an inside of the lower cover plate (2) provides a cavity (4) and a flange (5); and the magnetic core coil (6) is put in a space formed between the plastic insulating jacket (3), the cavity (4) and the flange (5).

8. The electronic transformer for low-voltage lamps according to claim 1, characterized in that a protecting film is adhered to exposed windings on an outside surface of the upper cover plate or on the outside surface of the lower cover plate.

9. The electronic transformer for low-voltage lamps according to claim 3, characterized in that:

the plastic insulating jacket (3) has a shape of an inverse flat pan; and the magnetic core coil (6) is put in the plastic insulating jacket (3).

10. The electronic transformer for low-voltage lamps according to claim 3, characterized in that:

an inside surface of the lower cover plate (2) provides a cavity (4) and a flange (5); and the magnetic core coil (6) is put in a space formed between the plastic insulating jacket (3), the cavity (4) and the flange (5).

11. The electronic transformer for low-voltage lamps according to claim 2, characterized in that a protecting film is adhered to exposed windings on an outside surface of the upper cover plate or on the outside surface of the lower cover plate.

* * * * *